US011488556B2

(12) United States Patent
Huang et al.

(10) Patent No.: US 11,488,556 B2
(45) Date of Patent: Nov. 1, 2022

(54) DRIVE CIRCUITRY OF DISPLAY PANEL FOR DETECTING A LOGIC VOLTAGE OF A LOGIC SIGNAL RECEIVING TERMINAL AND CONTROLLING A POWER TERMINAL OF A DRIVING CHIP TO BE CONNECTED TO OR DISCONNECTED FROM A POWER OUPUT TERMINAL OF A POWER CHIP DEPENDING ON A MAGNITUDE OF THE LOGIC SIGNAL AND DISPLAY DEVICE

(71) Applicants: HKC CORPORATION LIMITED, Shenzhen (CN); CHONGQING HKC OPTOELECTRONICSTECHNOLOGY CO., LTD., Chongqing (CN)

(72) Inventors: Xiaoyu Huang, Chongqing (CN); Chongwei Tang, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/327,788

(22) Filed: May 24, 2021

(65) Prior Publication Data

US 2022/0036843 A1 Feb. 3, 2022

(30) Foreign Application Priority Data

Jul. 31, 2020 (CN) ..... 202010754963.6

(51) Int. Cl.
*G09G 3/36* (2006.01)
*G09G 3/00* (2006.01)

(52) U.S. Cl.
CPC ..... *G09G 3/3648* (2013.01); *G09G 3/006* (2013.01); *G09G 3/3674* (2013.01);
(Continued)

(58) Field of Classification Search
CPC .... G09G 3/006; G09G 3/2092; G09G 3/2096; G09G 3/3266; G09G 3/3275; G09G 3/36; G09G 3/3648; G09G 3/3674; G09G 3/3677; G09G 3/3685; G09G 3/3688; G09G 3/3696; G09G 5/003; G09G 5/006; G09G 2310/0264; G09G 2310/08; G09G 2330/02; G09G 2330/021; G09G 2330/026; G09G 2330/12; G09G 2370/04; G09G 2370/08;
(Continued)

(56) References Cited

U.S. PATENT DOCUMENTS

2008/0180360 A1* 7/2008 Song ..... G09G 3/2927 345/60
2008/0204441 A1* 8/2008 Song ..... G09G 3/2927 345/211
(Continued)

*Primary Examiner* — Keith L Crawley

(57) ABSTRACT

This application provides a drive circuitry for a display panel and a display device. The drive circuitry includes a drive circuit board, a power chip, a driving chip, a detection circuit, and a control circuit. The detection circuit detects a logic voltage at a logic signal receiving terminal and outputs a control signal. The power terminal of the driving chip is coupled to the power chip through the control circuit. The control circuit controls to turn on or turn off the coupling between the power chip and the driving chip according to the control signal.

16 Claims, 2 Drawing Sheets

(52) U.S. Cl.
CPC ..... *G09G 3/3685* (2013.01); *G09G 2310/08* (2013.01); *G09G 2330/021* (2013.01); *G09G 2330/12* (2013.01)

(58) Field of Classification Search
CPC ..... G09G 2370/22; G01R 19/165; G01R 19/16552; G01R 19/16557; G01R 19/16538; G01R 19/1659; G01R 19/16595
See application file for complete search history.

(56) References Cited

U.S. PATENT DOCUMENTS

| | | | | |
|---|---|---|---|---|
| 2011/0310135 | A1* | 12/2011 | Feng | G09G 3/3648 345/690 |
| 2016/0154037 | A1* | 6/2016 | Kasturi | H02M 3/158 323/271 |
| 2019/0253048 | A1* | 8/2019 | Kim | G09G 5/18 |
| 2021/0281255 | A1* | 9/2021 | Tornare | H03K 5/2418 |

* cited by examiner

DRIVE CIRCUITRY OF DISPLAY PANEL FOR DETECTING A LOGIC VOLTAGE OF A LOGIC SIGNAL RECEIVING TERMINAL AND CONTROLLING A POWER TERMINAL OF A DRIVING CHIP TO BE CONNECTED TO OR DISCONNECTED FROM A POWER OUPUT TERMINAL OF A POWER CHIP DEPENDING ON A MAGNITUDE OF THE LOGIC SIGNAL AND DISPLAY DEVICE

The present application claims priority to Chinese Patent Application No. 202010754963.6, filed Jul. 31, 2020, which is hereby incorporated by reference herein as if set forth in its entirety.

TECHNICAL FIELD

This application relates to the field of display technology, and more particularly relates to a drive circuitry of a display panel, and a display device.

BACKGROUND

The statements herein merely provide background information related to the present application but don't necessarily constitute the prior art.

TFT-LCD (Thin-Film-Transistor Liquid-Crystal Display) is one of the main types of current flat panel displays and has become an important display platform in modern IT (Information Technology) and communication products. The main driving principle of TFT-LCD is that the system motherboard connects the R/G/B compression signals, the control signals, and the power supply to the connector on the drive circuit board through wires, and then the data is processed by a driving chip on the drive circuit board, and finally the display panel could obtain the required driving signals through a connection from the driving chip to a display area of the display panel.

The logic voltage of the logic signal receiving terminal of the driving chip needs to be set externally, but it may not be possible to determine the state of the logic voltage, which may eventually cause an abnormal operation of the system.

SUMMARY

This application provides a drive circuitry of a display panel as well as a display device that can avoid abnormal operation of the system.

This application provides a drive circuitry for a display panel, including: a drive circuit board, a driving chip, a detection circuit, and a control circuit. The drive circuit board is provided with a power chip. The driving chip includes a power terminal and a logic signal receiving terminal, and is configured to receive a driving signal to drive the display panel. The detection circuit is configured to detect a logic voltage of the logic signal receiving terminal, and output a control signal based on the magnitude of the logic voltage. The power terminal of the driving chip is coupled to a power output terminal of the power chip through the control circuit, and the control circuit is configured to turn on or turn off the coupling between the power chip and the driving chip according to the control signal.

This application further discloses a drive circuitry for a display panel, including: a drive circuit board, a driving chip, a voltage comparison circuit, and a control circuit. The drive circuit board is provided with a power chip. The driving chip includes a power terminal and a logic signal receiving terminal, and is configured to receive a driving signal to drive the display panel. One input terminal of the voltage comparison circuit is coupled to the logic signal receiving terminal, another input terminal is coupled to a first preset voltage, and yet another input terminal is connected to a second preset voltage. The voltage comparison circuit is configured to output a control signal based on the magnitude relationships between the logic voltage of the logic signal receiving terminal with the first preset voltage and the second preset voltage. The power terminal of the driving chip is coupled to a power output terminal of the power chip through the control circuit, and the control circuit is configured to turn on or turn off the coupling between the power chip and the driving chip according to the control signal, where an initial logic power supply voltage of the power chip is VDD, the first preset voltage is V1, the second preset voltage is V2, and the first preset voltage and the second preset voltage satisfy the following formula:

$$0.3VDD \leq V2 < V1 \leq 0.7VDD.$$

This application further discloses a display device, the display device includes a display panel and a driving circuitry of the display panel.

In this application, a drive circuitry is provided on the drive circuit board to detect the magnitude of the logic voltage of the logic signal receiving terminal on the driving chip. When the logic voltage is a high-level signal or a low-level signal, the control circuit controls the system to work normally. Otherwise when the logic voltage is in an intermediate state, the connection between the driving chip and the power chip is turn off to avoid abnormal operation of the system caused by the chip's inability to judge the state of the logic voltage.

BRIEF DESCRIPTION OF DRAWINGS

The drawings included herein are intended to provide a further understanding of the embodiments of the present application. They constitute a part of the specification, and are used to illustrate the embodiments of the present application, and explain the principle of the present application in conjunction with the specification. Apparently, the drawings in the following description merely represent some embodiments of the present disclosure, and for those having ordinary skill in the art, other drawings may also be obtained based on these drawings without investing creative efforts. In the drawings.

DETAILED DESCRIPTION OF EMBODIMENTS

Figure 1:
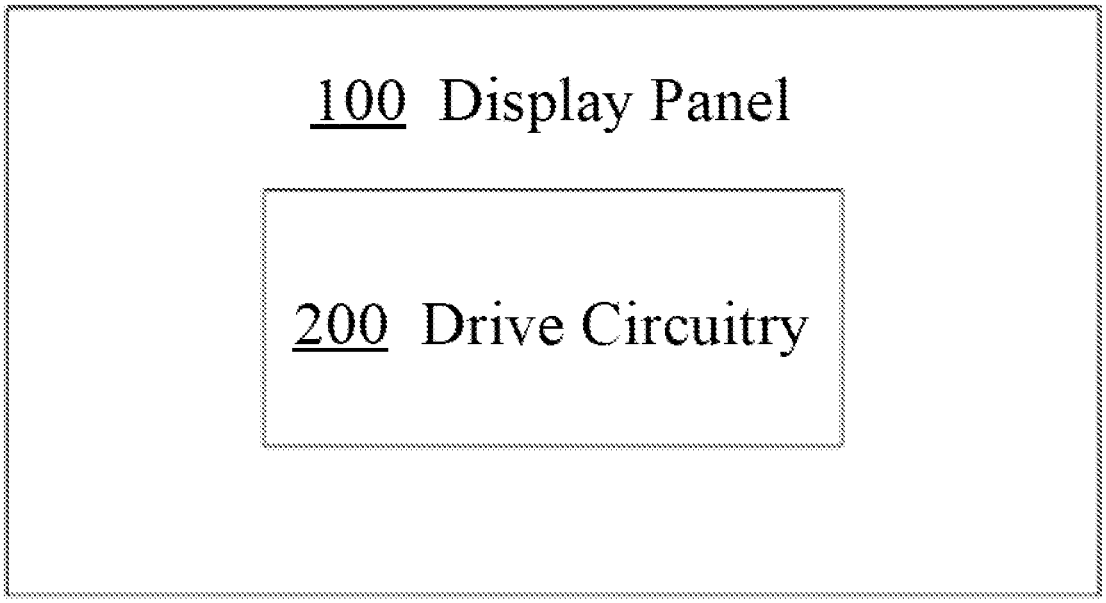
FIG. 1 is a schematic diagram of a display device according to an embodiment of the present application.

The specific structures and functional details disclosed herein are merely representative and are used for the purpose of describing some illustrative embodiments of the present application. However, this application may be implemented in many alternative forms and thus is not to be construed as being limited only to the embodiments set forth herein.

As used herein, the terms "center". "lateral", "up", "down", "left", "right", "vertical", "horizontal", "top", "bottom", "inside", "outside", and the like are used to indicate orientational or positional relationships based on those illustrated in the drawings. They are merely intended for the convenience of illustrating the present disclosure and simplifying the description, rather than indicating or implying that the device or element referred to must have a particular orientation or be constructed and operate in a particular orientation. Therefore, these terms should not be construed as restricting the present disclosure. In addition, terms like "first", "second", etc. are merely used for illustrative purposes, and shall not be construed as indicating or implying relative importance or implicitly indicating the number of specified technical features. Thus, the features defined by "first" and "second" may explicitly or implicitly include one or more of the features. As used herein, the term "a plurality" means two or more, unless specifically defined otherwise. In addition, terms "comprising", "including", and any variations thereof are intended to encompass a non-exclusive inclusion.

As used herein, terms "installed on", "connected to", "connected with", "coupled to", and "coupled with" should be understood in a broad sense unless otherwise specified and defined. For example, they may indicate a fixed connection, or a detachable connection, or an integral connection. They may be a mechanical connection and may also be an electrical connection or coupling. They may denote a direct connection, or may be a connection through an intermediate, or may be an internal communication between two elements. For those having ordinary skill in the art, the specific meanings of the above terms as used in the present application can be understood on a case-by-case basis.

The terminology used here is intended for the mere purpose of describing specific embodiments and is not intended to limit the present disclosure to the exemplary embodiments. Unless the context clearly dictates otherwise, the singular forms "a" and "one" used herein are intended to include the plural. It is also to be understood that the terms "including" and/or "comprising" used herein indicate the existence of specified features, integers, steps, operations, units, and/or components, and do not exclude the existence or addition of one or more other features, integers, steps, operations, units, components, and/or combinations thereof.

Hereinafter, this application will be described in further detail in connection with the drawings and some optional embodiments.

Figure 2:
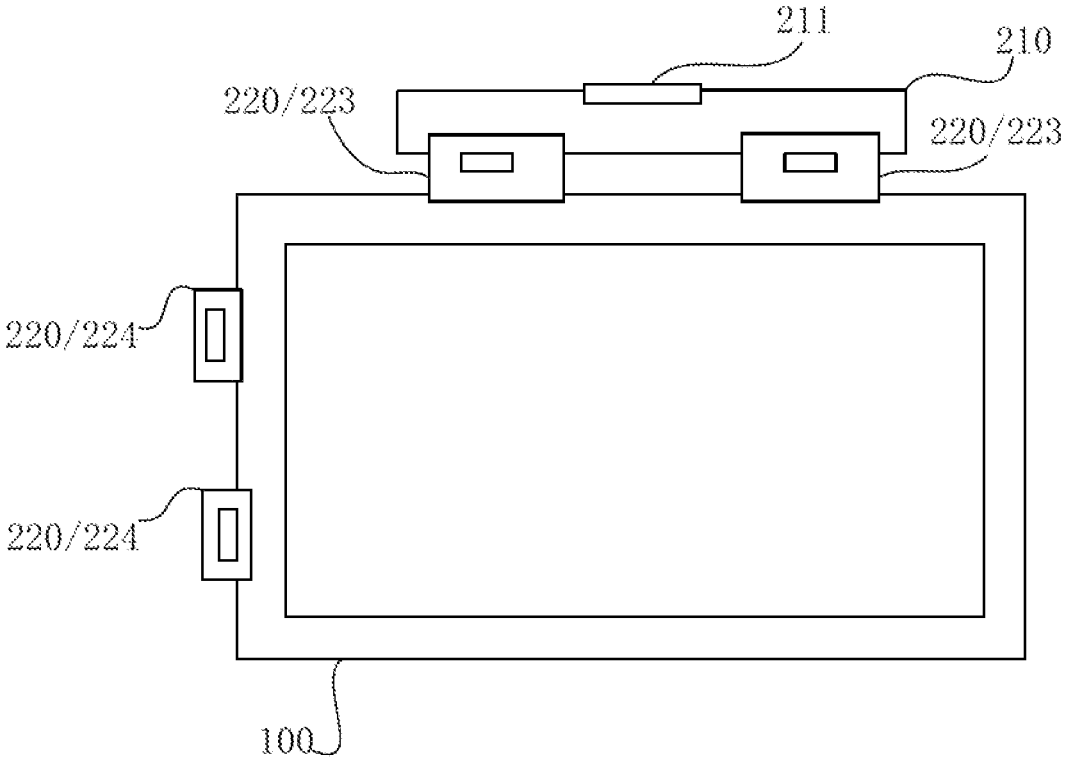
FIG. 2 is a schematic diagram of a display device according to an embodiment of the present application.
Figure 3:
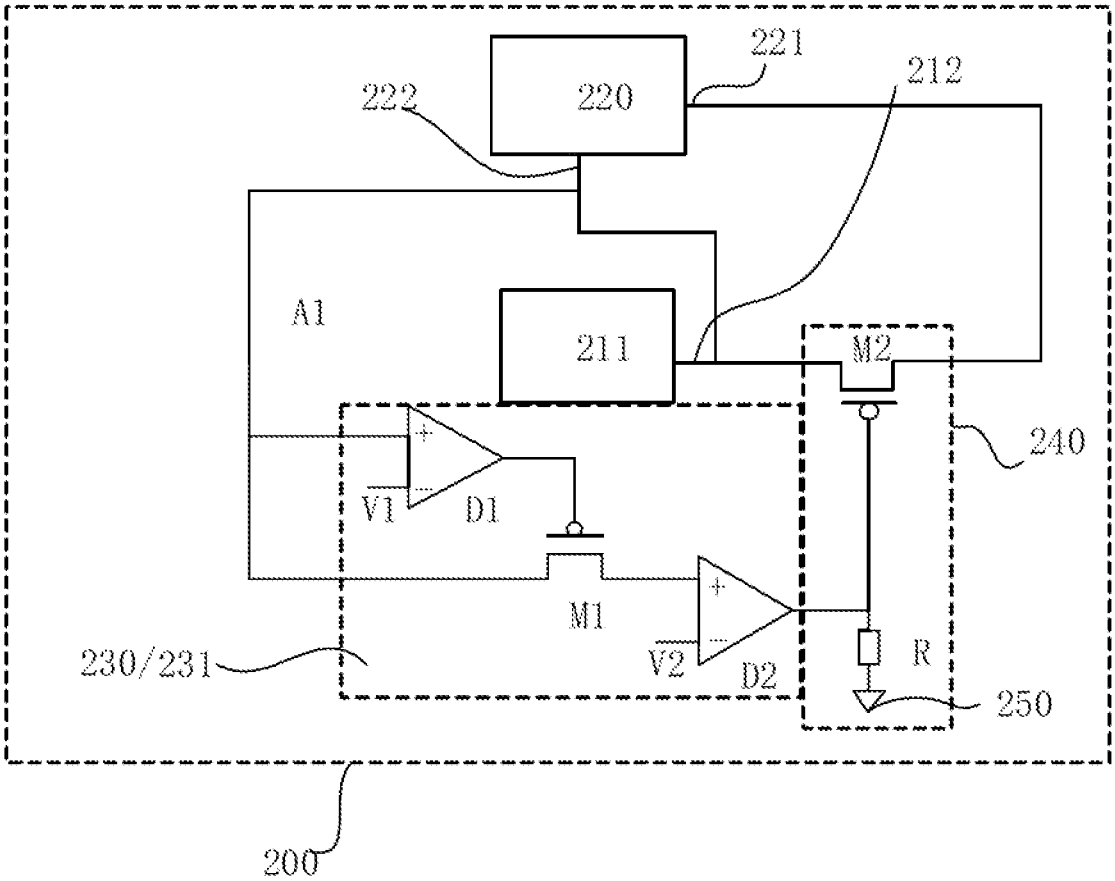
FIG. 3 is a schematic diagram of a drive circuitry of a display panel according to another embodiment of the present application.

Referring to FIGS. 1 to 3, the present application discloses a display device, the display device includes a display panel and a driving circuitry of the display panel. The drive circuitry 200 includes a drive circuit board 210. The drive circuit board 210 is provided with a power chip 211, a driving chip 220, a detection circuit 230, and a control circuit 240. The driving chip 220 includes a power terminal 221 and a logic signal receiving terminal 222. The power terminal 221 of the driving chip 220 is coupled to the power output terminal 212 of the power chip 211. The logic signal receiving terminal 222 is grounded or coupled to the power output terminal 212 of the power chip 211. The driving chip is configured to receive a driving signal to drive the display panel 100. The detection circuit 230 is configured to detect the logic voltage of the logic signal receiving terminal 222 and output a control signal according to the magnitude of the logic voltage. The power terminal 221 of the driving chip is coupled to the power output terminal 212 of the power chip 211 through the control circuit 240. The control circuit 240 is configured to receive the control signal, and control to turn on or turn off the connection between the power chip 211 and the driving chip 220 according to the control signal.

Some functions of the driving chip 220 need to be set externally. When the logic signal receiving terminal 222 of the driving chip 220 is set to a high level, it is coupled to the power output terminal 212 of the power chip 211. In this application, a detection circuit 230 and a control circuit 240 are provided on the drive circuit board 210 to detect the magnitude of the logic voltage of the logic signal receiving terminal 222, and output different control signals depending on different detection results. When the logic voltage is a high-level signal or a low-level signal, the driving chip 220 is in a normal working state, and the control circuit 240 keeps on the connection between the power chip 211 and the power terminal 221 of the driving chip 220. When the logic voltage is an intermediate state signal, the driving chip 220 goes abnormal, and the control circuit 240 cuts off the connection between the power chip 211 and the driving chip 220, so that the driving chip 220 stops working. This avoids an abnormal operation of the display panel caused by the abnormal logic voltage, thus improving the display quality of the display panel.

The driving chip 220 may include a gate driving chip 224 and a source driving chip 223, and the detection circuit 230 may be coupled to the logic signal receiving terminal 222 of the gate driving chip 224 or the source driving chip 223. The source driving chip 223 may be coupled to the drive circuit board 210 and a non-display area of the display panel 100, while the gate driving chip 224 may be disposed on the adjacent side of the display panel 100. The detection circuit 230 may be coupled to the source driving chip 223 or the gate driving chip 224, and can be coupled as required. Of course, the present drive circuitry may also be coupled to other chips, such as a timing control chip, to detect the magnitude of the chip voltage.

In particular, the detection circuit 230 may include a voltage comparison circuit 231. One input terminal of the voltage comparison circuit is coupled to the logic signal receiving terminal 222, and another input terminal is coupled to a preset voltage. The voltage comparison circuit 231 is configured to output the control signal based on the magnitude relationship between the logic voltage and the preset voltage.

The composition of the detection circuit 230 mainly serves two functions, one is detection, and the other is comparison of the detection results. When the corresponding voltage at the logic signal receiving terminal 222 of the driving chip 220 is set to a high level in this case, the logic signal receiving terminal 222 is coupled to the voltage of the power output terminal 212 of the power chip 211 (i.e., as illustrated in FIG. 3). When the corresponding voltage at the logic signal receiving terminal 222 of the driving chip 220 is set to a low level in this case, the logic signal receiving terminal 222 is grounded or coupled to another low-level signal. Specifically, the logic signal receiving terminal 222 may be coupled to different voltage signals as required by the setting at the logic signal receiving terminal 222. Then the voltage comparison circuit 231 is used to perform comparison, and output different control signals depending on the comparison.

The voltage comparison circuit 231 includes a first comparator D1, a second comparator D2, and a detection switch M1. The preset voltage includes a first preset voltage and a second preset voltage. The non-inverting input terminal of the first comparator D1 is coupled to the logic signal receiving terminal 222. The inverting input terminal of the first comparator D1 is coupled to the first preset voltage. The output terminal of the first comparator D1 is coupled to the control terminal of the detection switch M1. The input terminal of the detection switch M1 is coupled to the logic signal receiving terminal 222. The output terminal of the detection switch M1 is coupled to the non-inverting input terminal of the second comparator D2. The inverting input terminal of the second comparator D2 is coupled to the second preset voltage. The output terminal of the second comparator D2 is coupled to the control terminal of the control circuit 240. In the above, the detection switch M1 is tuned on at a low level, and the first preset voltage is greater than the second preset voltage. Suppose the initial logic power supply voltage of the power chip 211 is VDD, the first preset voltage is V1, the second preset voltage is V2, then the first preset voltage and the second preset voltage satisfy the following formula: $0.3VDD \leq V2 < V1 \leq 0.7VDD$.

More particularly, the first preset voltage V1 may be equal to 0.7VDD, and the second preset voltage V2 may be equal to 0.3VDD. The preset voltage is coupled to the voltage comparison circuit from the power chip. Such a design does not require an external power supply and so is more convenient.

Display panels 100 of different types and sizes set with different preset voltages depending on their own specific needs. Here V1 is 0.7VDD and V2 is 0.3VDD as an example, and the detection switch M1 is a low-level conduction switch, namely a P-type MOS tube (metal oxide semiconductor field effect transistor). When the control terminal of the detection switch M1 receives a low-level signal, it is turned on, and when it receives a high-level signal, it is turned off. When the non-inverting input terminal of each of the first comparator D1 and the second comparator D2 is greater than the inverting input terminal, the output terminal outputs a high level, and when the non-inverting input terminal is less than or equal to the inverting input terminal, a low level signal is output. The connection point A1 of the detection switch 230 detects the voltage of the logic signal receiving terminal 222. When the voltage value at the A1 point lies in the range of 0.7VDD to VDD, the voltage at the non-inverting input terminal of the first comparator D1 is greater than the first preset voltage. In this case, the first comparator D1 outputs a high level signal to the detection switch M1. At this time, the detection switch M1 is turned off, and so the output terminal of the detection switch M1 outputs a low level (0V) to the non-inverting input terminal of the second comparator D2. Thus, the voltage at the non-inverting input terminal of D2 is less than the second preset voltage at the inverting input terminal, and so the output terminal of the second comparator D2 outputs a low-level control signal to the control circuit 240. As a result, the control circuit 240 maintains the connection between the power chip 211 and the power terminal 221 of the driving chip 220, and so the system works normally.

When the voltage value at point A1 lies in the range of 0 to 0.3VDD, the voltage value at A1 which is coupled to the non-inverting input terminal of the first comparator D1 would be less than the first preset voltage, and so the first comparator D1 outputs a low-level signal to the detection switch M1, and as such the detection switch M1 is turned on. At this point, the non-inverting input terminal of the second comparator D2 is coupled to the voltage at point A1, so that the voltage at the non-inverting input terminal voltage of D2 is less than the second preset voltage, and so the second comparator D2 outputs a low level signal to the control circuit 240. As a result, the control circuit 240 maintains the connection between the power chip 211 and the driving chip 220, and so the system works normally. When the voltage at the connection point A1 lies in the range of 0.3VDD to 0.7VDD, the voltage at the logic signal receiving terminal 222 of the corresponding driving chip 220 is already an abnormal voltage in this case. In particular, the abnormal voltage may be caused by impurities, moisture, etc. present on the pins of the driving chip 220. If the connection between the power chip 211 and the power terminal 221 of the driving chip 220 is not turn off in time, the system will work abnormally thus affecting the screen display. At this time, the voltage at the non-inverting input terminal of the first comparator D1 is less than the first preset voltage, and so the first comparator D1 outputs a low-level signal to the control terminal of the detection switch M1, and as a result the detection switch M1 is turned on. Thus, the non-inverting input terminal of the second comparator D2 is coupled to the voltage signal at point A1, so that the voltage at the non-inverting input terminal of the second comparator D2 is greater than the second preset voltage, and as a result the second comparator D2 outputs a high level signal to the control circuit 240. As such, the control circuit 240 cuts off the connection between the power chip 211 and the power terminal 221 of the driving chip 220, so that the driving chip 220 stops working, thus protecting the drive circuitry of the display panel. When the voltage signal voltage at point A1 is 0.7VDD, the first comparator may output a low-level voltage, and the final result is also that the control circuit 240 cuts off the connection between the power terminal 221 of the driving chip 220 and the power chip 211.

The detection circuit 230 may further include a grounding resistor R, a grounding wire 250, and a control switch 240. The power terminal 221 of the driving chip 220 is coupled to the power output terminal 212 of the power chip 211 through the control switch. One end of the grounding resistor R is coupled to the output terminal of the detection circuit 230 and to the control terminal of the control switch M2, and the other end of the grounding resistor R is coupled to the grounding wire 250. The grounding resistor is coupled to the grounding wire 250 to provide a low-level signal to the control circuit 240. When there is no output from the output terminal of the second comparator D2, the control circuit 240 can still be kept on.

In particular, the control switch M2 is turned on at low level (that is, the control switch M2 is a P-type MOS transistor). The input terminal of the control switch M2 is coupled to the logic power supply voltage of the power chip 211, the output terminal is coupled to the power terminal 221 of the driving chip 220, and the control terminal is coupled to the output terminal of the second comparator D2. The control switch M2 is turned on when the second comparator D2 outputs a low-level signal, and is turned off when the second comparator D2 outputs a high-level signal. Depending on different voltages at the logic signal receiving terminal 222, different processing methods are adopted, thus avoiding the occurrence of abnormal operation of the system caused by the driving chip 220 being unable to identify the logic voltage when the logic voltage is in an intermediate state.

The technical solutions of this application may be widely used in the low-level liquid crystal manufacturing process of various display panels, such as TN (Twisted Nematic) display panels, IPS (In-Plane Switching) display panels, VA (Vertical Alignment) 1) Display panel, MVA (Multi-Domain Vertical Alignment) display panels. Of course, the above solutions may also be applicable to other types of display panels.

The foregoing is merely an optional detailed description of the present application in connection with some specific illustrative implementations, and it is to be construed as limiting the implementation of the present application to these implementations. For those having ordinary skill in the technical field to which this application pertains, numerous simple deductions or substitutions may be made without departing from the concept of this application, which shall all be regarded as falling in the scope of protection of this application.

What is claimed is:

1. A drive circuitry for a display panel, comprising:

a drive circuit board, comprising a power chip disposed thereon;

a driving chip, comprising a power terminal and a logic signal receiving terminal, the driving chip being configured to receive a driving signal to drive the display panel;

a detection circuit, configured to detect a logic voltage of the logic signal receiving terminal and output a control signal depending on a magnitude of the logic voltage; and a control circuit;

wherein the power terminal of the driving chip is coupled to a power output terminal of the power chip through the control circuit, wherein the control circuit is configured to control to turn on or cut off an electrical connection between the power chip and the driving chip according to the control signal;

wherein the detection circuit comprises:

a voltage comparison circuit, comprising an input terminal directly electrically connected to the logic signal receiving terminal and another input terminal directly electrically connected to a preset voltage, the voltage comparison circuit being configured to output the control signal depending on a magnitude relationship between the logic voltage and the preset voltage;

wherein the voltage comparison circuit comprises a first comparator, a second comparator, and a detection switch, wherein the preset voltage comprises a first preset voltage and a second preset voltage;

wherein the first comparator comprises a non-inverting input terminal directly electrically connected to the logic signal receiving terminal, an inverting input terminal directly electrically connected to the first preset voltage, and an output terminal directly electrically connected to a control terminal of the detection switch;

wherein the detection switch comprises an input terminal directly electrically connected to the logic signal receiving terminal, and an output terminal directly electrically connected to a non-inverting input terminal of the second comparator;

wherein the second comparator comprises an inverting input terminal directly electrically connected to the second preset voltage, and an output terminal directly electrically connected to a control terminal of the control circuit;

wherein the detection switch is turned on at a low level, and the first preset voltage is greater than the second preset voltage;

wherein when the logic voltage is lower than the second preset voltage, the output terminal of the first comparator outputs a low level to the control terminal of the detection switch to turn on the detection switch, and the logic voltage is transmitted through the input terminal of the detection switch to the output terminal of the detection switch and further to the non-inverting input terminal of the second comparator; and wherein at the second comparator, because the logic voltage is lower than the second preset voltage, the second comparator is operative to output a low level which is transferred to the control terminal of control switch to turn on the control switch, causing the power terminal of the driving chip to be electrically connected to the power output terminal of the power chip;

wherein when the logic voltage is greater than the first preset voltage, then the first comparator outputs a high level to the control terminal of the detection switch, which is thus turned off and so outputs a low level to the non-inverting input terminal of the second comparator; wherein at the second comparator, because the low level is less than the second preset voltage input to the inverting input terminal of the second comparator, the second comparator outputs a low level to the control terminal of control switch, which is thus turned on causing the power terminal of the driving chip to be electrically connected to the power output terminal of the power chip;

wherein when the logic voltage is greater than the second preset voltage and less than the first preset voltage, then the first comparator outputs a low level to the control terminal of the detection switch, which is thus turned on and so the logic voltage is transferred through the input terminal of detection switch to the output terminal of the detection switch and further to the non-inverting input terminal of the second comparator; and wherein at the second comparator, because the logic voltage is greater than the second preset voltage, the second comparator outputs a high level to the control terminal of control switch, which is thus turned off causing the power terminal of the driving chip to be electrically disconnected to the power output terminal of the power chip.

2. The drive circuitry of claim 1, wherein the control circuit comprises a grounding resistor, a grounding wire, and a control switch, wherein the power terminal of the driving chip is coupled to the power output terminal of the power chip through the control switch, and wherein the grounding resistor comprises one terminal directly electrically connected to the output terminal of the detection circuit and to the control terminal of the control switch, and another terminal directly electrically connected to the grounding wire.

3. The drive circuitry of claim 2, wherein the control switch is turned on at a low level.

4. The drive circuitry of claim 1, wherein let an initial logic power supply voltage of the power chip be VDD, the first preset voltage be V1, and the second preset voltage be V2, then the first preset voltage and the second preset voltage satisfy the following formula: $0.3VDD \leq V2 < V1 \leq 0.7VDD$.

5. The drive circuitry of claim 4, wherein the first preset voltage is equal to 0.7VDD, and the second preset voltage V2 is equal to 0.3VDD.

6. The drive circuitry of claim 5, wherein the first preset voltage and the second preset voltage are provided by the power chip.

7. The drive circuitry of claim 5, wherein the output terminal of each of the first comparator and the second comparator is operative to output a high level when the non-inverting input terminal is greater than the inverting input terminal, and is operative to output a low level signal when the non-inverting input terminal is less than or equal to the inverting input terminal.

8. The drive circuitry of claim 1, wherein the driving chip comprises a gate driving chip, and the detection circuit is directly electrically connected to the logic signal receiving terminal of the gate driving chip.

9. The drive circuitry of claim 1, wherein the driving chip comprises a source driving chip, and the detection circuit is directly electrically connected to the logic signal receiving terminal of the source driving chip.

10. The drive circuitry of claim 1, wherein the drive circuitry is directly electrically connected to a timing control chip.

11. The drive circuitry of claim 1, wherein the control circuit comprises a grounding resistor, a grounding wire, and a control switch, wherein the power terminal of the driving chip is coupled to the power output terminal of the power chip through the control switch, and wherein the grounding resistor comprises one terminal directly electrically connected to an output terminal of the second comparator and to the control terminal of the control switch, and another terminal directly electrically connected to the grounding wire, and wherein the detection switch and the control switch operate on the same conduction logic.

12. The drive circuitry of claim 11, wherein the detection switch and the control switch are each turned on at a low level.

13. A drive circuitry for a display panel, comprising:

a drive circuit board, provided with a power chip disposed thereon;

a driving chip, comprising a power terminal and a logic signal receiving terminal, the driving chip being configured to receive a driving signal to drive the display panel;

a voltage comparison circuit, comprising a first comparator, a second comparator, and a detection switch, wherein the first comparator comprises a non-inverting input terminal directly electrically connected to the logic signal receiving terminal, an inverting input terminal directly electrically connected to a first preset voltage, and an output terminal directly, electrically connected to a control terminal of the detection switch; wherein the detection switch further comprises an input terminal directly electrically connected to the logic signal receiving terminal, and an output terminal directly electrically connected to a non-inverting input terminal of the second comparator; and a control circuit, wherein the power terminal of the driving chip is coupled to power output terminal of the power chip through the control circuit, wherein the second comparator further comprises an inverting input terminal directly electrically connected to a second preset voltage; and an output terminal directly electrically connected to a control terminal of the control circuit, wherein the voltage comparison circuit is configured to output the control signal depending on a magnitude relationship between a logic voltage of the logic signal receiving terminal with the first preset voltage and the second preset voltage, and wherein the control circuit is configured to control to turn on or turn off the electrical connection between the power chip and the driving chip depending on the control signal;

wherein let an initial logic power supply voltage of the power chip be VDD, the first preset voltage be V1, and the second preset voltage be V2, then the first preset voltage and the second preset voltage satisfy the following formula: $0.3VDD \leq V2 < V1 \leq 0.7VDD$;

wherein when the logic voltage is lower than the second preset voltage, the output terminal of the first comparator outputs a low level to the control terminal of the detection switch to turn on the detection switch, and the logic voltage is transmitted through the input terminal of the detection switch to the output terminal of the detection switch and further to the non-inverting input terminal of the second comparator; and wherein at the second comparator, because the logic voltage is lower than the second preset voltage, the second comparator is operative to output a low level which is transferred to the control terminal of control switch to turn on the control switch, causing the power terminal of the driving chip to be electrically connected to the power output terminal of the power chip;

wherein when the logic voltage is greater than the first preset voltage, then the first comparator outputs a high level to the control terminal of the detection switch, which is thus turned off and so outputs a low level to the non-inverting input terminal of the second comparator; wherein at the second comparator, because the low level is less than the second preset voltage input to the inverting input terminal of the second comparator, the second comparator outputs a low level to the control terminal of control switch, which is thus turned on causing the power terminal of the driving chip to be electrically connected to the power output terminal of the power chip;

wherein when the logic voltage is greater than the second preset voltage and less than the first preset voltage, then the first comparator outputs a low level to the control terminal of the detection switch, which is thus turned on and so the logic voltage is transferred through the input terminal of detection switch to the output terminal of the detection switch and further to the non-inverting input terminal of the second comparator; and wherein at the second comparator, because the logic voltage is greater than the second preset voltage, the second comparator outputs a high level to the control terminal of control switch, which is thus turned off causing the power terminal of the driving chip to be electrically disconnected to the power output terminal of the power chip.

14. A display device, comprising a display panel and a driving circuitry of the display panel, the drive circuitry comprising:

a drive circuit board, provided with a power chip disposed thereon;

a driving chip, comprising a power terminal and a logic signal receiving terminal, the driving chip being configured to receive a driving signal to drive the display panel;

a detection circuit, configured to detect a logic voltage of the logic signal receiving terminal and output a control signal depending on a magnitude of the logic voltage; and a control circuit, wherein the power terminal of the driving chip is coupled to power output terminal of the power chip through the control circuit, the control circuit being configured to control to turn on or cut off an electrical connection between the power chip and the driving chip according to the control signal;

wherein the detection circuit comprises:

a voltage comparison circuit comprising a first comparator, a second comparator and a detection switch;

wherein the first comparator comprises a non-inverting input terminal directly electrically connected to the logic signal receiving terminal, an inverting input terminal directly electrically connected to a first preset voltage, and an output terminal directly electrically connected to a control terminal of the detection switch;

wherein the detection switch comprises an input terminal directly electrically connected to the logic signal receiving terminal, and an output terminal directly electrically connected to a non-inverting input terminal of the second comparator;

wherein the second comparator comprises an inverting input terminal directly electrically connected to a second preset voltage, and an output terminal directly electrically connected to a control terminal of the control circuit;

wherein the detection switch is turned on at a low level, and the first preset voltage is greater than the second preset voltage;

wherein when the logic voltage is lower than the second preset voltage, the output terminal of the first comparator outputs a low level to the control terminal of the detection switch to turn on the detection switch, and the logic voltage is transmitted through the input terminal of the detection switch to the output terminal of the detection switch and further to the non-inverting input, terminal of the second comparator; and wherein at the second comparator, because the logic voltage is lower than the second preset voltage, the second comparator is operative to output a low level which is transferred to the control terminal of control switch to turn on the control switch, causing the power terminal of the driving chip to be electrically connected to the power output terminal of the power chip;

wherein when the logic voltage is greater than the first preset voltage, then the first comparator outputs a high level to the control terminal of the detection switch, which is thus turned off and so outputs a low level to the non-inverting input terminal of the second comparator; wherein at the second comparator, because the low level is less than the second preset voltage input to the inverting input terminal of the second comparator, the second comparator outputs a low level to the control terminal of control switch, which is thus turned on causing the power terminal of the driving chip to be electrically connected to the power output terminal of the power chip;

wherein when the logic voltage is greater than the second preset voltage and less than the first preset voltage then the first comparator outputs a low level to the control terminal of the detection switch, which is thus turned on and so the logic voltage is transferred through the input terminal of detection switch to the output terminal of the detection switch and further to the non-inverting input terminal of the second comparator; and wherein at the second comparator, because the logic voltage is greater than the second preset voltage, the second comparator outputs a high level to the control terminal of control switch, which is thus turned off causing the power terminal of the driving chip to be electrically disconnected to the power output terminal of the power chip.

15. The display device of claim 14, wherein control circuit comprises a grounding resistor, a grounding wire, and a control switch, wherein the power terminal of the driving chip is coupled to the power output terminal of the power chip through the control switch, and wherein the grounding resistor comprises one terminal directly electrically connected to the output terminal of the detection circuit and to the control terminal of the control switch, and another terminal directly electrically connected to the grounding wire;

wherein let an initial logic power supply voltage of the power chip be VDD, the first preset voltage be V1, and the second preset voltage be V2, then the first preset voltage and the second preset voltage satisfy the following formula: $0.3\ VDD \leq V2 < V1 \leq 0.7VDD$, and wherein the control switch is turned on at a low level.

16. The drive circuitry of claim 1, wherein the display panel is a liquid crystal display panel.

* * * * *